US005924346A

United States Patent [19]

Wunderlich et al.

[11] Patent Number: 5,924,346

[45] **Date of Patent: *Jul. 20, 1999**

[54] METHOD AND APPARATUS FOR TRANSVERSE CUTTING

[75] Inventors: Gary R. Wunderlich; Larry D. Wierschke, both of Green Bay, Wis.

[73] Assignee: Paper Converting Machine Company, Green Bay, Wis.

[ * ] Notice: This patent is subject to a terminal disclaimer.

[21] Appl. No.: 08/718,089

[22] Filed: Sep. 17, 1996

Related U.S. Application Data

[63] Continuation-in-part of application No. 08/223,543, Apr. 6, 1994, Pat. No. 5,557,997.

[51] Int. Cl.[6] ..... B26D 1/58; B26D 7/12

[52] U.S. Cl. ..... 83/37; 83/174; 83/327; 83/329; 83/377; 83/471.3; 83/698.51

[58] Field of Search ..... 83/37, 174, 329, 83/327, 337, 471.1, 471.3, 473, 490, 698.51

[56] References Cited

U.S. PATENT DOCUMENTS

| | | | |
|---|---|---|---|
| Re. 30,598 | 5/1981 | Spencer . | |
| 1,630,132 | 5/1927 | Molins . | |
| 1,746,594 | 2/1930 | Jacobson | 83/471.3 |
| 1,784,443 | 12/1930 | Hohn | 83/329 |
| 1,846,942 | 2/1932 | Bronander et al. . | |
| 2,093,323 | 9/1937 | Lamoreaux . | |
| 2,140,720 | 12/1938 | Road | 83/329 |
| 2,704,560 | 3/1955 | Woessner | 83/473 |
| 2,752,999 | 7/1956 | Gage . | |
| 2,769,600 | 11/1956 | Kwitek et al. . | |
| 2,833,024 | 5/1958 | Boehm et al. | 83/329 |
| 3,213,731 | 10/1965 | Renard . | |
| 3,213,734 | 10/1965 | Nystrand . | |
| 3,218,898 | 11/1965 | Briscoe | 83/337 |
| 3,292,470 | 12/1966 | Nystrand . | |
| 3,380,331 | 4/1968 | Boothe, Jr. et al. | 83/490 |
| 3,905,260 | 9/1975 | Nystrand . | |
| 4,041,813 | 8/1977 | Spencer | 83/14 |
| 4,052,048 | 10/1977 | Shirasaka | 270/40 |
| 4,173,846 | 11/1979 | Steiner et al. . | |
| 4,347,771 | 9/1982 | Bradley . | |
| 4,584,917 | 4/1986 | Blom . | |
| 4,914,997 | 4/1990 | Belvederi . | 83/329 |
| 5,152,203 | 10/1992 | Wierschke . | |
| 5,289,747 | 3/1994 | Wunderlich . | |
| 5,315,907 | 5/1994 | Biagiotti | 83/38 |
| 5,557,997 | 9/1996 | Wunderlich et al. | 83/174 |

FOREIGN PATENT DOCUMENTS

| | | |
|---|---|---|
| 930737 | 7/1955 | Germany . |
| 248415 | 3/1926 | United Kingdom . |
| 307153 | 3/1929 | United Kingdom . |
| 337225 | 10/1930 | United Kingdom . |
| 452180 | 8/1936 | United Kingdom . |

*Primary Examiner*—Rinaldi I. Rada
*Assistant Examiner*—Charles Goodman

[57] ABSTRACT

A method of operating an orbital saw for transversely severing elongated, superposed, multi-ply web material which includes advancing the web material along a path into a cutting station having a skew arm adjacent said path, rotating said arm about an axis skewed with respect to the path, the skew arm having a disc blade coupling means, such as a 4-bar linkage, mounted thereon and carrying a rotating disc blade with the blade axis spaced from the arm axis to cause the blade to intersect the path and cut the web material during the blade orbit, maintaining the blade axis at an angle skewed relative to the arm axis to position the disc blade continually perpendicular to the path whereby the disc blade makes a square cut through the web material, providing the coupling means with a grinding stone for the blade and a control for contacting the grinding stone and blade, and positioning the grinding stone radially inwardly throughout the entirety of the blade orbit whereby centrifugal forces are reduced and cyclic loading is substantially eliminated.

21 Claims, 9 Drawing Sheets

FIG. 9

FIG. 1
PRIOR ART
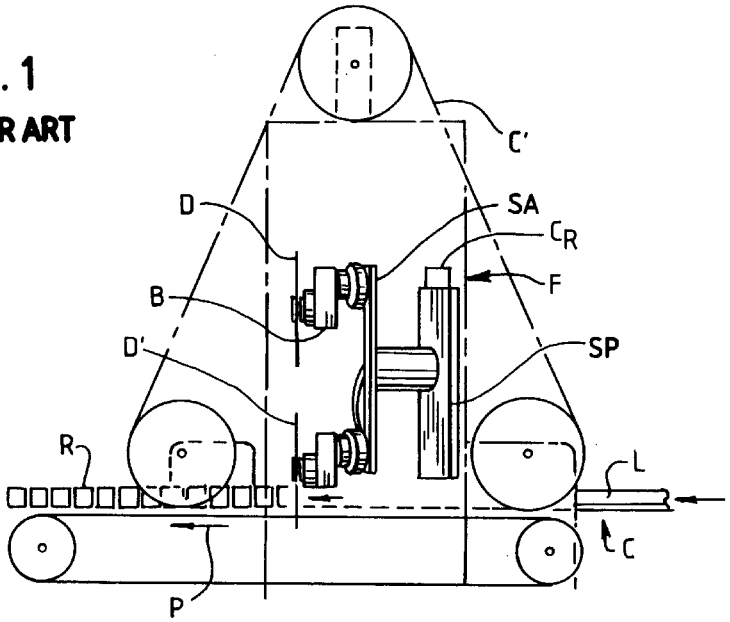
FIG. 2
PRIOR ART
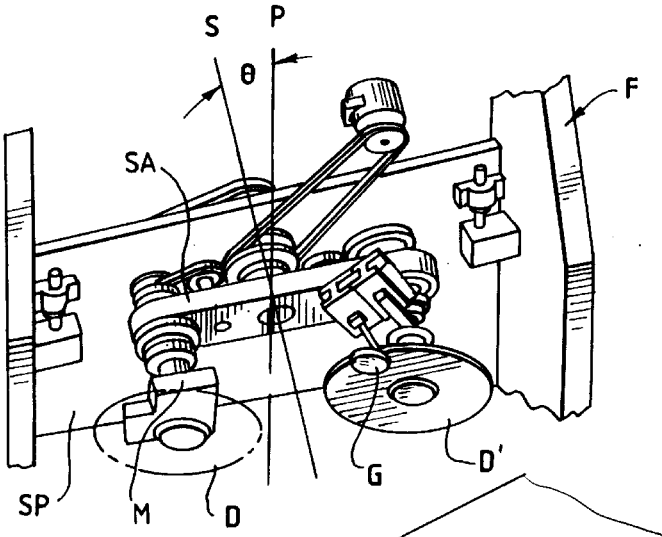
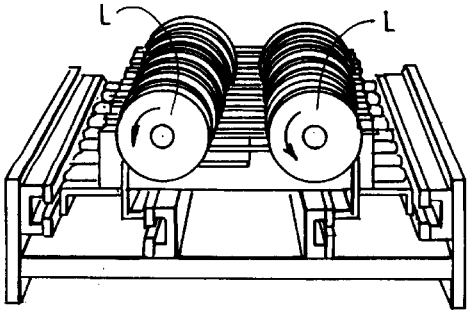
FIG. 3
PRIOR ART
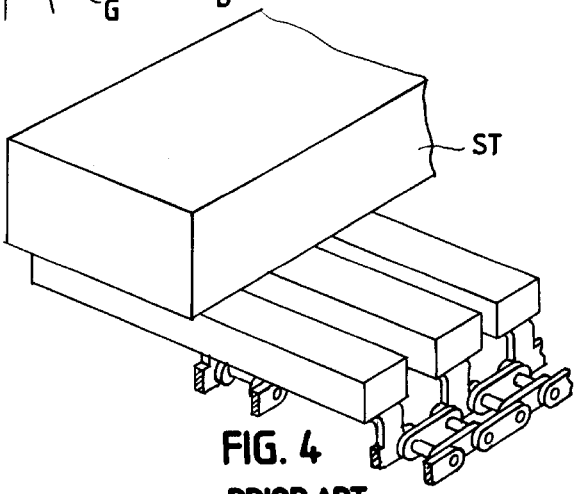
FIG. 4
PRIOR ART FIG. 5
PRIOR ART
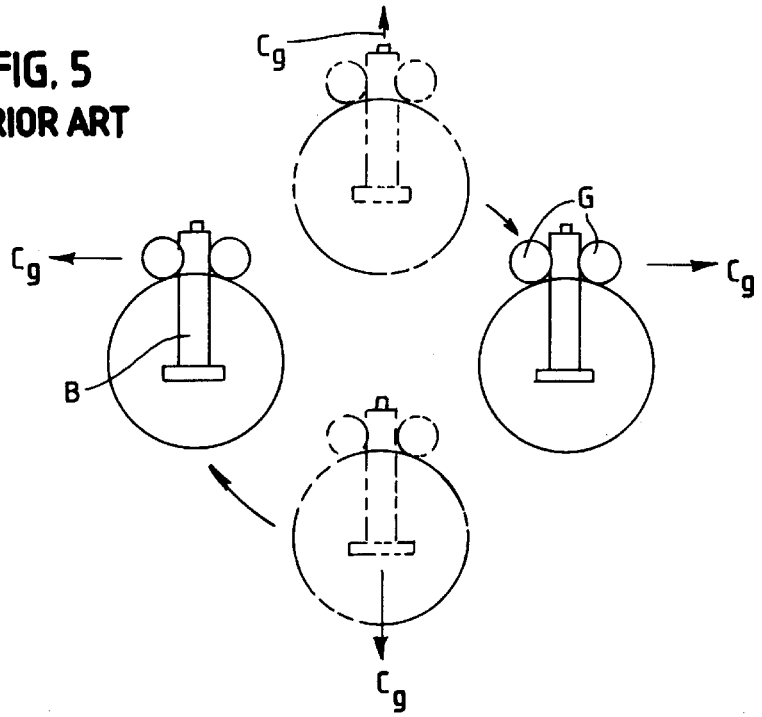
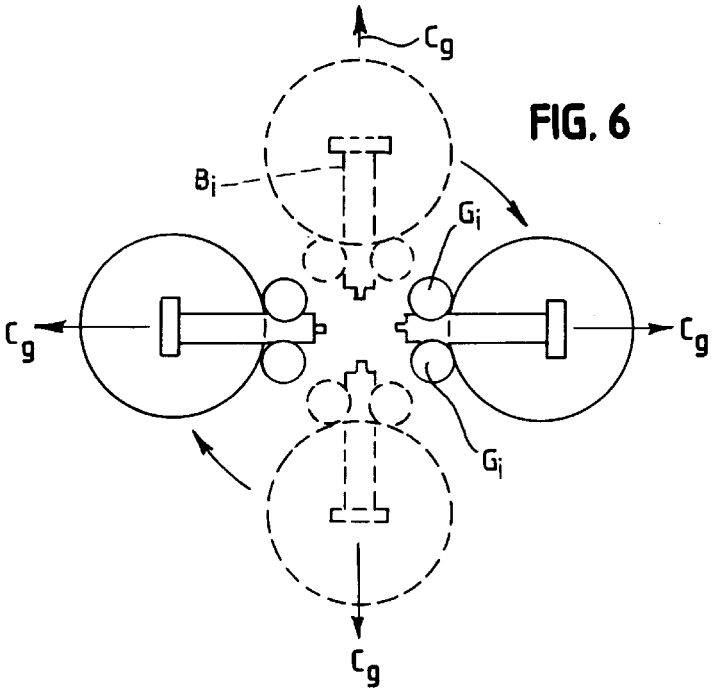
FIG. 6
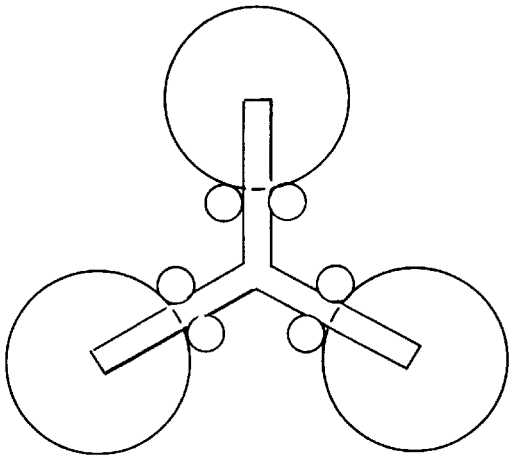
FIG. 7

METHOD AND APPARATUS FOR TRANSVERSE CUTTING

This application is a continuation-in-part of application Ser. No. 08/223,543, filed Apr. 6, 1994, now US. Pat. No. 5,557,997.

BACKGROUND AND SUMMARY OF INVENTION

This invention relates to a method and apparatus for transverse cutting of multi-ply web material and, more particularly, to a continuous motion saw. A continuous motion saw is designed to cut a product in motion. Illustrative products are "logs" of bathroom tissue and kitchen toweling. The invention, however, is not limited to such products but can be used to advantage on other multi-ply products, such as bolts or continuous superposed plies of facial tissue, interfolded or otherwise.

The illustrative products, for example, are produced at high speed on machines termed "reminders". These machines start with a parent roll perhaps 10 feet long (2.3 meters) and about 8 feet (1.9 meters) in diameter—resulting from the output of a paper-making machine. The parent roll is unwound to provide a web which can be transversely perforated and then rewound into retail size rolls of at least 3.5 inches (89 mm) in diameter for bathroom tissue and kitchen toweling, viz. a cross-sectional area of 9.6 $in^2$ (6190 $mm^2$). Conventional high speed automatic rewinders can produce upwards of 30 logs per minute. These logs then are delivered to a log saw where they are moved axially for severing into retail size lengths. In the case of facial tissue, the product may be continuous (as in co-owned U.S. Pat. No. 4,052,048) and this also requires transverse cutting at regular intervals. In this case the minimum cross-sectional area is at least 3.5 $in^2$ (2200 $mm^2$).

Saws for making bathroom tissue, kitchen toweling, etc. started being used in the middle 1950s principally for toilet tissue and have come to be known as "log saws". Prior to that time, the retail size rolls were made by slitting the web on the rewinder. For example, spaced slitting wheels are shown operating against a slitting roll in co-owned U.S. Pat. No. 2,769,600. This proved unsatisfactory. When the wide web being processed had holes stemming from manufacture on the paper machine, slitting would cause at least one of the narrower webs to jam the rewinder. This required shutdown and cleaning out the jam. To avoid this recurring problem of dealing with "fish-eyes" in the web, the web was rewound as a log. So, to cut the log into the retail size lengths, a log saw was needed.

The first commercially successful log saw was the "Gilbertville" saw of Gage, U.S. Pat. No. 2,752,999. This saw operated intermittently—swinging downwardly and upwardly (in knife-like fashion) against the log which was indexed a product length (4½" for bathroom tissue) while the saw disc was lifted upwardly way from the log path. Sharpening of the saw disc occurred also when the disc was upwardly out of the log path.

The next commercially successful log saw is seen in co-owned U.S. Pat. No. 3,213,731. This differed from the Gilbertville saw in having the saw disc move through an orbit—passing through the log or logs at the nadir of the orbit. Sharpening occurred when the disc was upwardly out of the path. However, as with the Gilbertville saws, the operation was still intermittent—only having the saw cut the log after it had been indexed the appropriate distance.

The next major development was in the mid-1970s with the use of the continuous motion (CM) saw as seen in co-owned U.S. Pat. No. 4,041,813. This differed in two major respects from the prior log saws. The log was advanced continuously and the saw was orbited continuously. This was achieved by having the orbit axis skewed relative to the path of the log travel and providing skew compensation—to dispose the blade at a right angle to the log. The angle of skew was of the order of a few degrees—sufficient to accommodate the space in between cuts. Until the instant invention, the '813 saw represented the state of the art. A saw of competitive manufacture is seen in U.S. Pat. No. 5,315,907 where the movement was reciprocal, not continuous.

It has always been necessary to maintain a razor-like sharpness on the cutting edge of the blades. To do this, the sharpening system of the '813 patent had to be mounted on the angled housings and had to follow the planetary motion. Because the sharpening stones or grinders used for sharpening were mounted out near the blade's edge, each blade/grinder assembly was difficult to balance, especially due to the changing position of the grinders as the blade diameter decreases. Since the system was generally out of balance, the planetary gear train had to deal with the constant imbalance torque and its cyclic nature, reversing once each revolution. The planetary motion also put the grinders into completely reversing cyclic loading causing component fatigue and grind quality problems as the production speed increased.

In particular, the design of the '813 cutter head was complex both in the drive and in the blade orienting planetary system. However, no better CM saw was available for twenty years and the drawbacks of cyclic loading due to planetary motion had to be tolerated.

The problem, therefore, was to produce this same type of blade action but without the use of planetary motion. For this, the invention provides a motion that allows for locating the grinders at a lesser orbit radius than the blade center and leaves them always toward the center of rotation, thereby eliminating the cyclic centrifugal forces. More particularly, the invention involves positioning the grinding stone or stones radially inward of the blade orbit.

This, by itself, was well known via co-owned U.S. Pat. No. 4,584,917 but this was not for a CM saw where the stone cyclic loadings were encountered. Rather, the '917 saw had an intermittent feed, viz., "indexing" which was characteristic of the pre-'813 saws.

Representative of the prior art for sharpening orbiting knife blades operating in slots in a wheel is in the field of yarn cutting—U.S. Pat. No. 3,218,898. The knife blades rotate slower than the turntable which carries them and the sharpening grindstones which sharpen the blades constantly throughout the operation. This is in the field of yarn cutting but it teaches the sharpening of the blades constantly throughout the cutting operation. This is because periodic sharpening was only satisfactory at low speeds. In '898, this was due to the impact velocity of the knife upon the stone being sufficient to make the stone rebound away from the knife and not allow the knife to be sharpened.

More significant is the fact that the '898 saw was not even capable of keeping a blade perpendicular to the product. Because it was cutting filaments, the cutting duration was an instant in time and squareness of cuts do not matter nor are measurable. Even further, the orbit in '898 was not skewed to the product and the reference even states that the orbit is normal to the filament. From a cutting aspect, this saw is more primitive than a Gilbertville saw. In contrast, the invention provides a grinding system which will provide periodic sharpening, as continuous sharpening is not wanted due to excessive blade heat, then blade warps, and ultimately the blades become out of round.

The invention is described in conjunction with illustrative embodiments in the accompanying drawing.

BRIEF DESCRIPTION OF DRAWING

Sheet 1

FIG. 1 is a schematic side elevational view of a continuous motion saw according to the prior art;

FIG. 2 is a fragmentary perspective view of a continuous motion saw according to the prior art;

FIG. 3 is a fragmentary end elevational view of the prior art product conveyor arranged for advancing logs;

FIG. 4 is a view similar to FIG. 3 but arranged for advancing facial tissue;

Sheet 2

FIG. 5 is a schematic view showing the orbiting of a blade according to the prior art continuous motion saw of the '813 patent;

FIG. 6 is a view similar to FIG. 5 but featuring the orbiting of the instant inventive saw;

FIG. 7 is a view similar to FIG. 6 but of a modified embodiment of the invention;

Sheet 3

Figure 8:
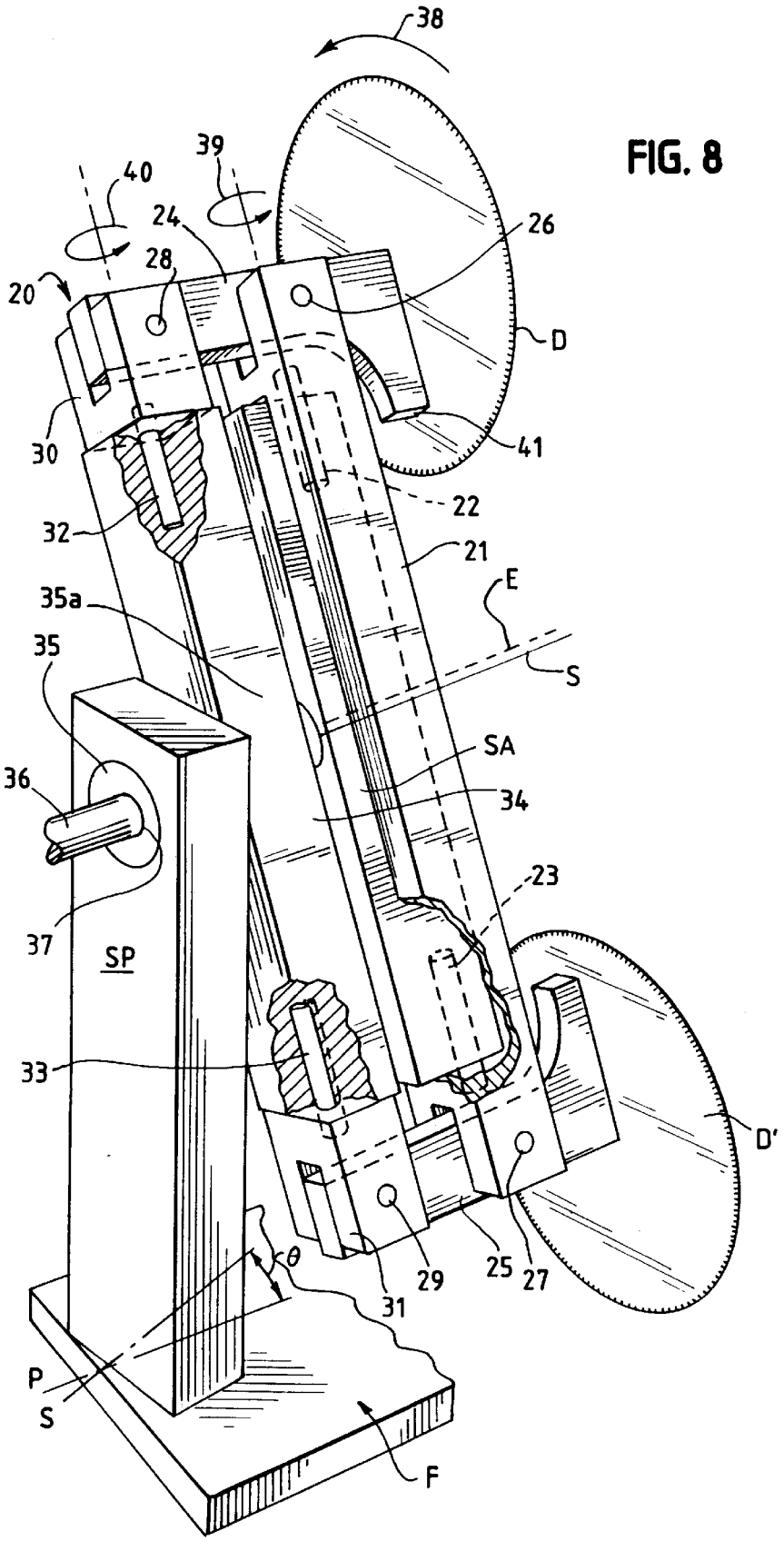

FIG. 8 is a schematic perspective view of a model featuring the teachings of the first embodiment of the invention;

Sheet 4

Figure 9:
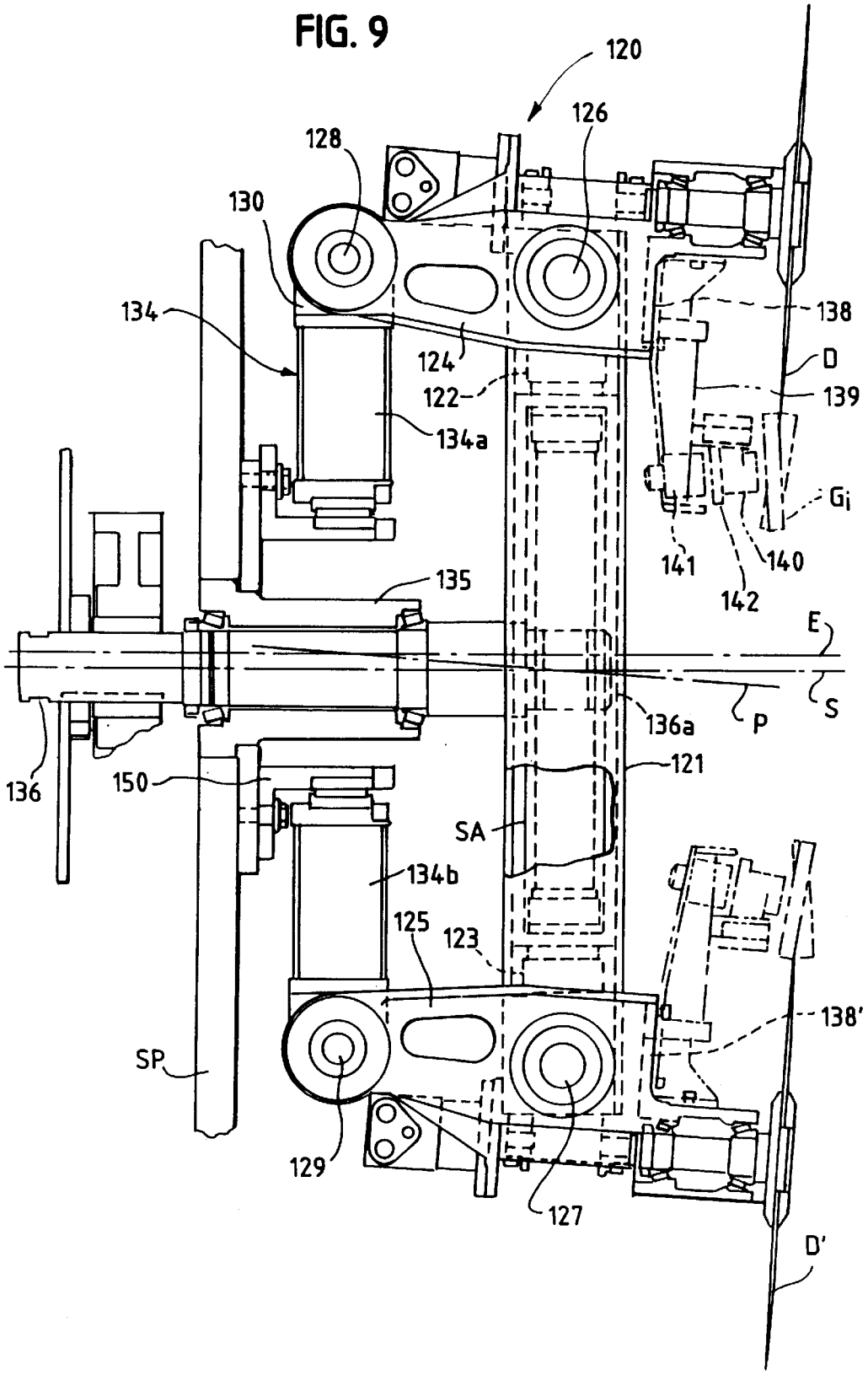

FIG. 9 is a plan of a commercial embodiment of the first embodiment of the inventive saw;

Sheet 5

Figure 10:
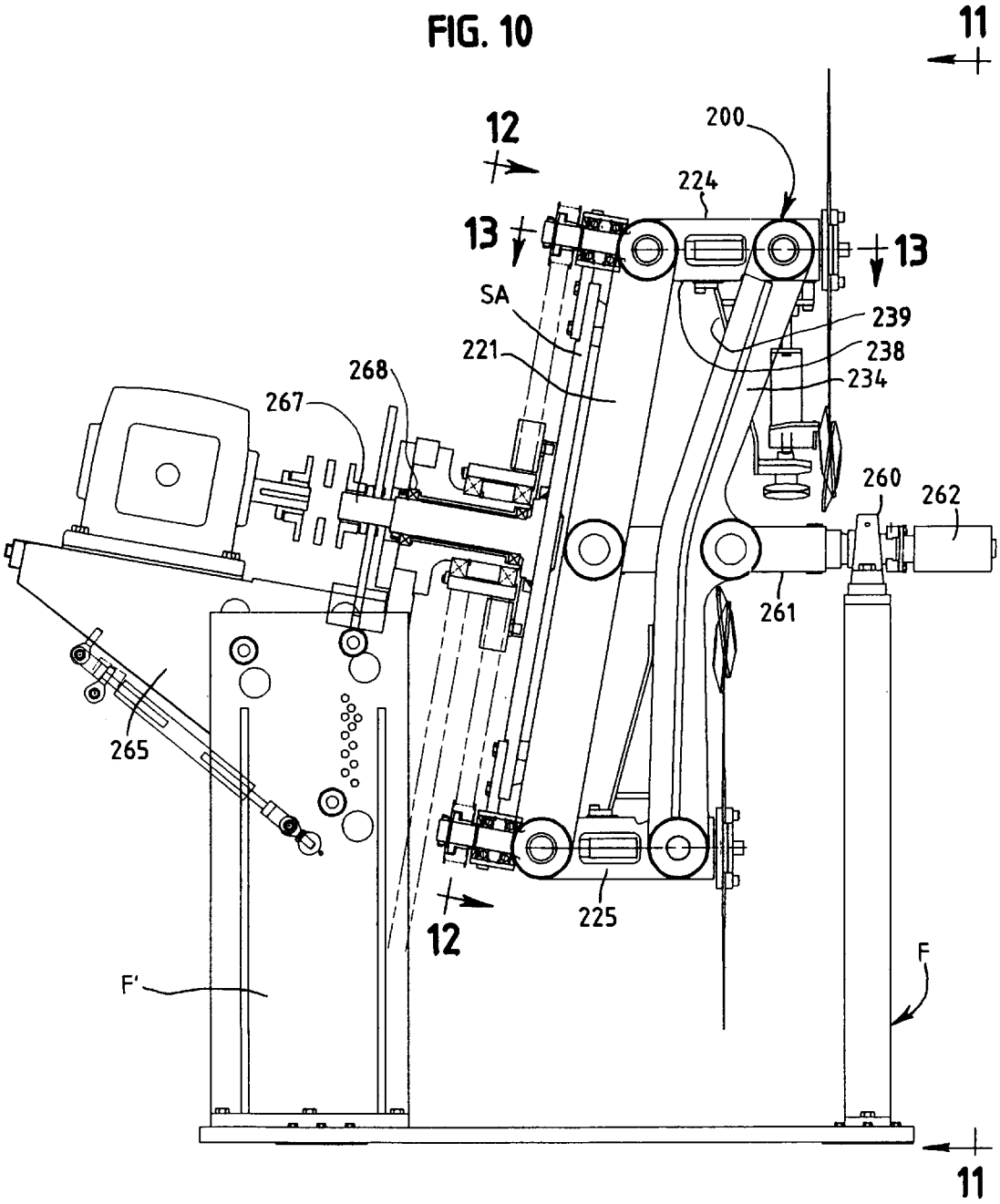

FIG. 10 is a fragmentary side elevational view of a second embodiment of the invention;

Sheet 6

FIG. 10 is a view similar to FIG. 10 but more detailed;

Sheet 7

Figure 11:
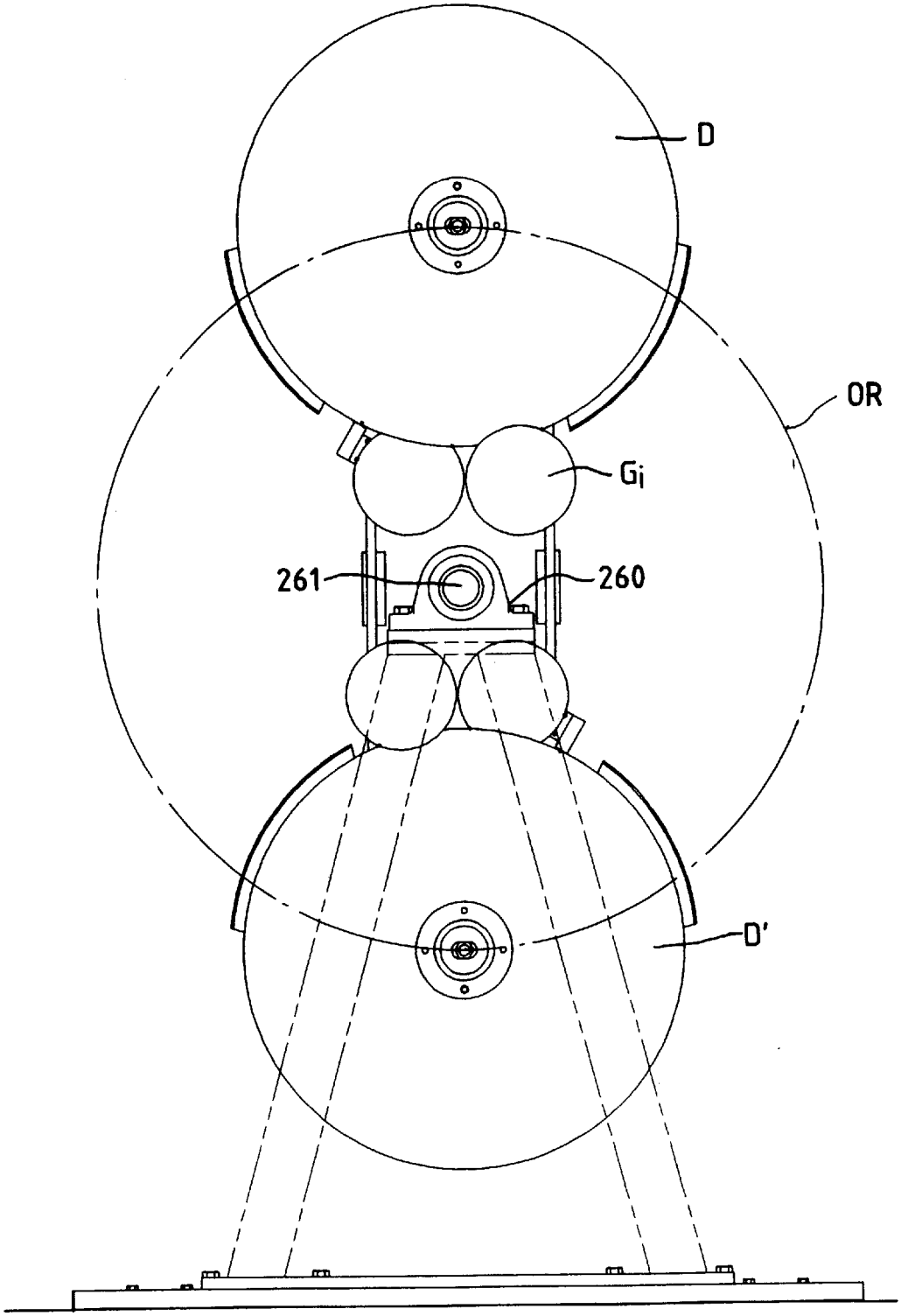

FIG. 11 is an end elevational view of the embodiment of FIG. 10 as seen along the line 11—11 in FIG. 10;

Sheet 8

Figure 11A:
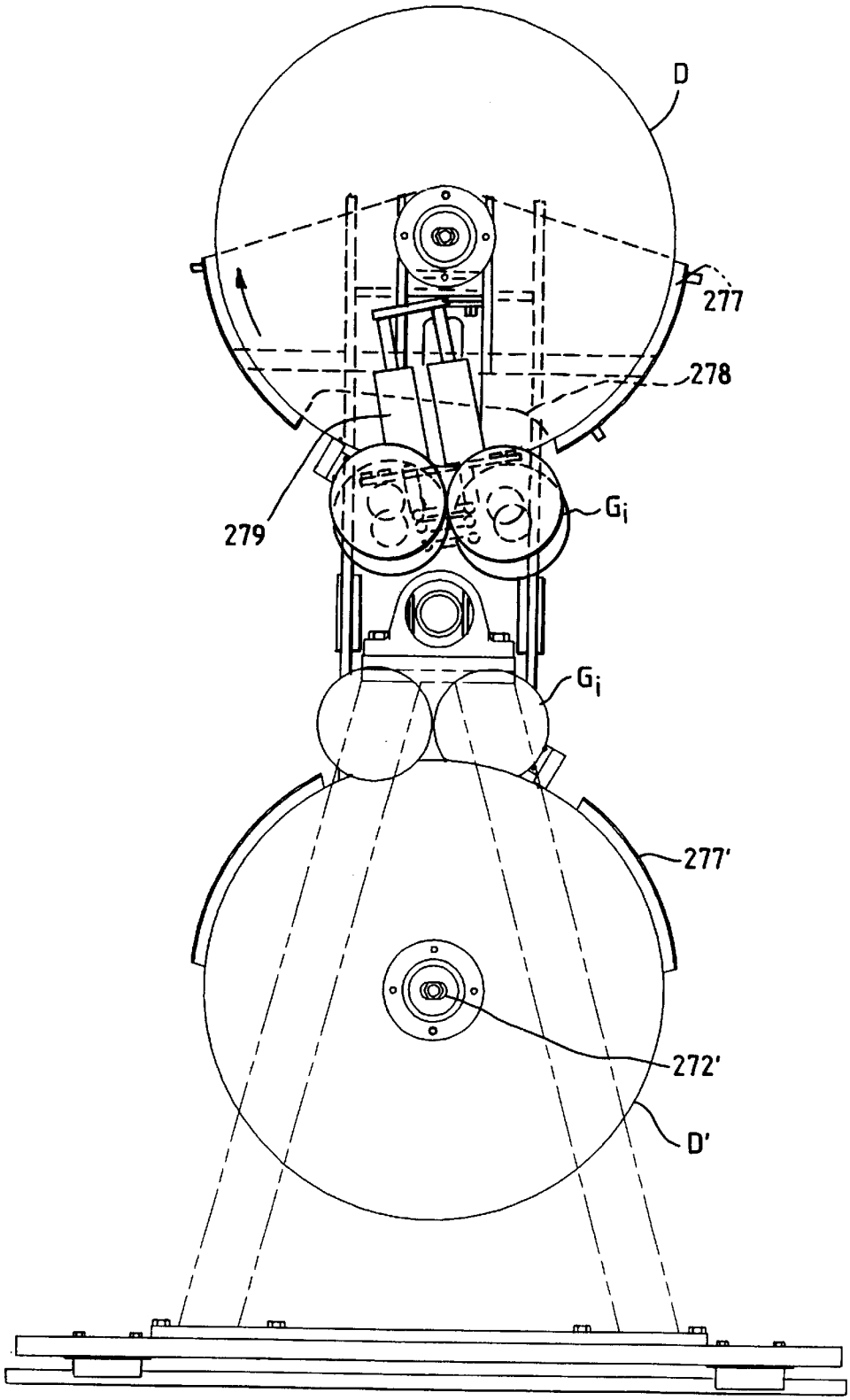

FIG. 11A is a view similar to FIG. 11 but showing additional details;

Sheet 9

Figure 12:
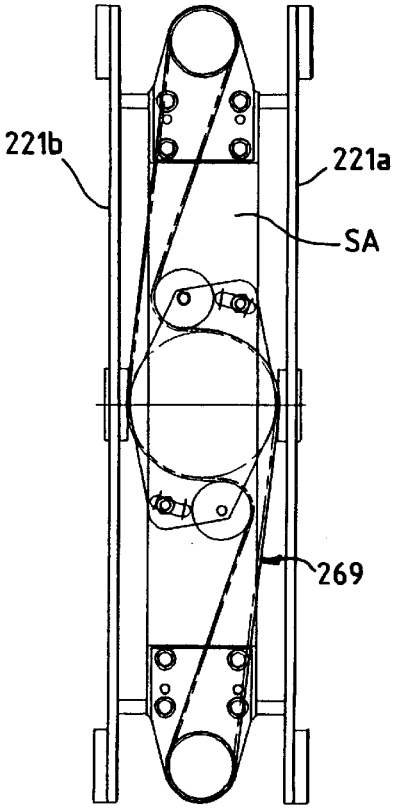
Figure 13:
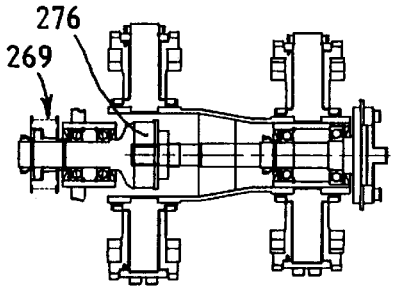
Figure 13A:
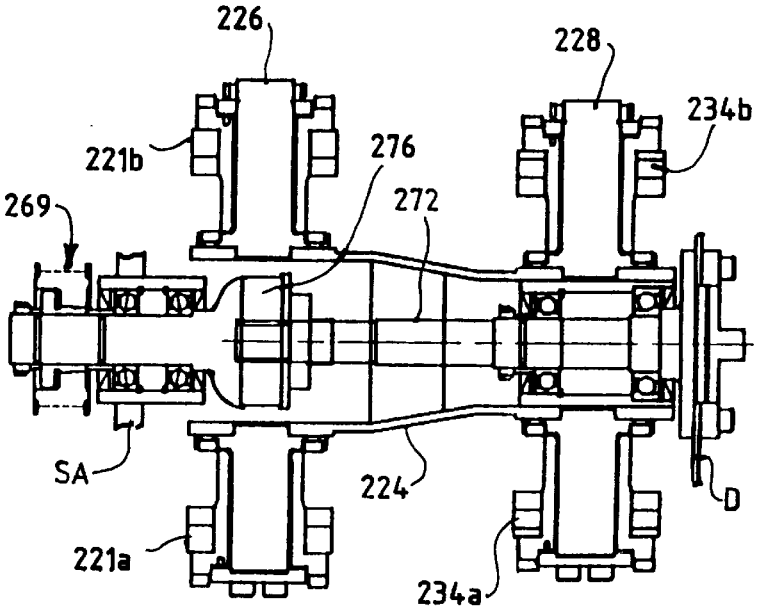

FIG. 12 is a partial sectional view as seen along the line 12—12 of FIG. 10;

FIG. 13 is a partial sectional view as seen along the line 13—13 of FIG. 10; and FIG. 13A is a view similar to FIG. 13 but enlarged and featuring additional details.

DETAILED DESCRIPTION

Prior Art

Referring first to FIG. 1 the symbol F designates generally the frame of the machine which can be seen in FIG. 2 to include a pair of side frames.

The frame F provides a path P which extends linearly, horizontally for the conveying of logs L and ultimately the severed rolls R. The logs and thereafter the rolls are conveyed along the path P by a suitable conveyor generally designated C. The symbol M designates generally the blade support mechanism which includes two disc blades D, D'—see also FIG. 2. As can be seen from FIG. 2, there is provided a bracket B for each blade which support the usual grinders G.

The blades B and their associated structure are carried by a skew plate SP which supports the skew arm SA for rotation about a skew axis S which is arranged at a minor acute angle θ to the path P (see the upper central portion of FIG. 2).

FIGS. 3 and 4 illustrate the two principal products handled by the CM saw. In both cases, the conveyor C has upper and lower runs to confine the entering material and issuing product top and bottom. For example, relative to the logs L seen in FIG. 3, a detailed description of the conveyor C can be found in the above-mentioned '813 patent. There, it was pointed out that the triangular configuration of the conveyor chains—see the designation C' in FIG. 1—avoids any interference of the return run of upper chains with the cutting mechanism. The same arrangement has been used for stacked tissues ST as illustrated in FIG. 4—the difference being the shape of the conveyor cross bars confronting the material being introduced into the saw station and the product issuing therefrom. In FIG. 4, the cross bars are flat rather than cylindrically contoured as in FIG. 3.

Advantage Relative to "a" Forces

Reference now is made to FIGS. 5 and 6 which illustrate a significant advantage of the invention. In FIG. 5 for example, the grinders G—see also FIG. 2—are mounted on brackets B and maintain the same relationship to the frame throughout the orbit of the disc blades D, i.e., always being above the blades D. This results in a constantly changing force on the grinders. For example, at a planetary motion speed of 200 rpm the acceleration force $C_g$ due to centrifugal movement is 27.5 times "g". In contrast, in FIG. 6 while maintaining the same blade sweep radius and where the grinders do not follow a planetary movement but are always oriented in the same distance from the axis of rotation of the blades, the force $C_g$ is only 21.5 times "g" and this at higher 250 rpm. This results from the inventive grinders $G_i$ being mounted on the brackets $B_i$, respectively. There was no such arrangement in the prior art. Thus, the invention provides a significant advantage in first lowering centrifugal forces and second in maintaining a force that is in a constant direction relative to the grinders.

It will be appreciated that the invention finds advantageous application to saws with one or more blades. The usual arrangement is with two blades as seen in FIG. 6. However, more blades can be used—as, for example, the three blade version of FIG. 7. This is advantageous with the illustrated four-bar linkage compensation for skew. The inboard placement is helpful itself in reducing centrifugal forces and substantially eliminating cyclic loading.

Basic Environment of the Invention

The invention is first described in connection with an environmental model in FIG. 8. This permits the description of the basic components free of many of the details present in the commercial machine of FIGS. 9–10 and which feature the inventive inboard mounting of the sharpening stones or grinders. It will be appreciated that the commercial machine like the model makes use of a 4-bar linkage. To the best of applicants' knowledge, this type of mechanism has not been used in the paper converting industry notwithstanding the long availability of 4 bar type saws with such usages in cigarette machines—see, for example, U.S. Pat. Nos. 1,630,132 and 1,846,942. The normal cigarette rod has a cross-sectional area of about 0.07 $in^2$ (45 $mm^2$) in contrast to converted paper products which have a minimum cross-sectional area of 3.5 $in^2$ (2200 $mm^2$).

In FIG. 8 the symbol F again designates generally a frame which provides a support for the skew plate designated SP. As before, the skew plate SP carries the skew arm SA which in turn ultimately provides a support for orbiting, rotating disc blades D, D'.

As can be appreciated from what has been said before, here the similarity ends between the invention and the prior art. In particular, there is considerably more involved in compensating for the skew angle θ between the axis S of arm rotation and the path P. Instead of having the blades D, D' of FIG. 8 fixed at the compensating angle θ as were the disc blades D, D' in FIGS. 1 and 2, the invention makes the compensation by employing an eccentric and pivotal connections providing two degrees of pivotal freedom. For example, the prior art machine utilized mounting blocks B that were angled and then orbited with a planetary motion so as to maintain the disc blades D, D' always perpendicular to the path P. This brought about the problems previously discussed—complexity of machinery and heavy cyclic "g" loads in particular.

Here, the invention makes use of a 4-bar linkage generally designated 20 versus the planetary mechanism of the prior art log saw. This linkage includes an arm-like first bar 21 which is pivotally connected as at 22, 23 to the ends of the skew arm SA. In turn, the clevis-like ends of first bar 21 are pivotally connected to third and fourth bars or brackets 24 and 25 via transversely-extending pivot rods 26, 27—just to the left of blades D, D'. At their ends opposite the blades D, D', the third and fourth bars 24, 25 are pivotally connected via transversely extending pivot rods 28, 29 to the clevises 30, 31—see the left side of FIG. 8. These clevises, in turn, are pivotally connected via longitudinally-extending pivot posts 32, 33 to the second bar 34. Thus, the 4-bar linkage includes first bar 21, second bar 34, third bar 24 and fourth bar 25.

Mounting of 4-Bar Lintage

Both the skew arm SA (and therefore, the first bar 21) and the second bar 34 are rotatably mounted relative to the skew plate SP—and therefore the frame F. For this purpose, the skew plate SP is equipped with a bearing 35 in which a drive shaft 36 is journaled eccentrically as at 37 revolving on axis S. The shaft 36 is fixedly connected to the skew arm SA while the bearing 35 extends into the second bar 34—which is rotatably mounted thereon establishing axis E. So, the second bar 34 is eccentrically mounted relative to the drive shaft 36 and can be considered a control arm to correct for the skew angle.

Inasmuch as the skew arm SA is fixedly connected to the drive shaft 36 and perpendicular thereto—it rotates in a plane which is skewed relative to the path P, i.e., it is perpendicular to the axis S. This also applies to the first bar 21. But the second bar 34 rotates in a plane perpendicular to the path P and thus compensates for the skew angle θ and positions the blades D, D' perpendicular to the path P so as to provide a "square" cut. But, unlike the prior art '813 patent, this is not done by making a single compensation (via mounting blocks in the mechanism M), but is done by using an eccentric plus connections that provide at least two degrees of rotational or pivotal freedom. This can best be appreciated from a description of what happens when the upper one of the blades D travels in the direction of the arrow 38 from a 3 o'clock position—as in the right hand portion in FIG. 6 to the 6 o'clock position.

OPERATION

As a blade D orbits from the 3 o'clock position toward cutting contact with a log, the first bar 21 pivots relative to the skew arm SA—this on the pivot posts 22, 23 as indicated by the arrow 39. At the 3 o'clock position, the descending end of the second bar 34 is in its furthest position from the skew axis S, i.e., the axis of the drive shaft 36. This can be appreciated from the location of the eccentric bore 37—see the left side of FIG. 8. Then, as the second bar 34 continues to rotate—by virtue of being coupled to the skew arm SA, through third and fourth bars 24, 25 and first bar 21—the descending end of the second bar 34 comes closer and closer to the skew axis S, and is closest at the 9 o'clock position. The other end of the second bar or control arm 34 follows the same pattern.

What this means is that the contribution of the eccentric mounting of the second bar 34 toward compensating for skew varies, i.e., decreases in going from the 3 o'clock position to the 9 o'clock position. This results in the second bar 34 pulling the third bar 24 about the pivot post 32. This pivot post is in the clevis 30 and the third bar 24 and the movement is designated by the arrow 40.

This necessarily occurs because the second bar 34, the clevis connection 30, the third bar 24, the first bar 21 (with skew arm SA), fourth bar 25 and clevis 31 form, in essence, a generally planar four-bar linkage. This also includes the pivots 28, 26, 27 and 29 in proceeding clockwise around the four-bar linkage. And this linkage is fixed in the plane of rotation just described because the downstream end of the shaft 36 is fixed to the skew arm SA which in turn is fixed against longitudinal movement in the first bar 21. Thus, the pivots 22, 23, 32, 33 are generally parallel to the length of the first bar 21 and the pivots 26, 27, 28 and 29 are generally perpendicular to the linkage plane.

However, at the same time, there is a rotation about the longitudinally-extending pivot posts 22, 23 at the ends of the skew arm SA and also the counterpart longitudinally-extending pivot posts 32, 33 at the ends of the second bar 34. This necessarily occurs because the eccentric mounting of the second bar 34 on the bearing 35 produces a rectilinear movement of the second bar 34, i.e., a movement that has both "horizontal" and "vertical" components.

This extra component results in a twisting of the drive or first bar 21 (permitted because of the pivotal connection with the skew arm SA) and which is reflected in changing the orientation of the third and fourth bars 24, 25 and, hence the blades D, D'. So the inventive arrangement compensates for the departure of the blades from "squareness" by virtue of being skewed by the eccentricity of the drive shaft 36 and its coupling to the four-bar linkage. There are other ways of pivotally coupling the various members of the four-bar linkage—in particular, substituting at least a universal or spherical joint for the pivots 28, 32 and 29, 33.

The invention has been described thus far in connection with a schematic model. Now the description is continued in connection with a first commercial version—this in connection with FIG. 9.

First Embodiment

The symbol SP again designates the skew plate which has rigidly fixed therein the bearing 135 which rotatably carries the drive shaft 136—see the lower left hand portion of FIG. 9. Affixed to the right hand end of drive shaft 136, as at 136*a*, is the skew arm SA—seen in solid lines in the broken away portion of the first bar 121 of the 4-bar linkage generally designated 120 As with the model embodiment of FIG. 8, the symbols P, S and E refer respectively to the product path, the skew and the eccentric.

As before, there are pivot post connections between the skew arm SA and first bar 121 as at 122 at the top and 123 at the bottom. At its upper end, the first bar 121 is equipped with a transversely extending pivot rod as at 126 and which connects the first bar 121 to the upper bracket or third bar 124. In similar fashion, the pivot rod 127 connects the lower end of the first bar 121 to the lower bracket or fourth bar 125.

Now considering the left hand end of the third bar 124 (in the upper left hand portion of FIG. 9), the numeral 128 designates a transversely extending pivot rod pivotally attached to bearing housing 130 mounted on the upper end 134*a* of the second bar generally-designated 134. The lower end 134*b* of the second bar is pivotally connected to the fourth bar 125 by pivot rod 129. Here, it will be noted that the second bar 134 is somewhat different from the straight control bar 34 of the model of FIG. 8 in that it has two parts, each associated with a different third and second bar as seen in FIG. 9—124 at the upper end 134*a* and 125 at the lower end 134*b*. In between, the parts are connected by an enlargement to accommodate the adjustable eccentric means 150 as seen in co-owned application Ser. No. 08/223,543 filed Apr. 8, 1994, now U.S. Pat. No. 5,557,997.

Still referring to FIG. 9, it will be seen in the upper right hand corner that there is a mounting surface 138 provided at the work end of the third bar 124. This carries the grinder or sharpening means $G_i$ associated with the upper disc blade D. In similar fashion, a similar surface 138' is provided in the lower right hand portion of FIG. 9 for carrying the sharpening means for the other blade D'. Because the constructions are the same for the upper and lower grinders and disc blades, only the one shown in the upper position in FIG. 9 will be described. Boltably secured to the surface 138 is a bracket or arm member 139. This carries a bearing 140 which in turn rotatably carries a shaft for the grinding stones $G_i$. A pair of motors, one of which is shown at 141, powers the grinding stones $G_i$ to provide a beveled edge for the upper disc blade D. A suitable installation is seen in either of co-owned U.S. Pat. Nos. 5,152,203 and 4,347,771 and reference may be had thereto for additional details. Advantageously, these stones are operated intermittently—as by being brought into contact with their associated blade only when sharpening is indicated. For this purpose, a control actuated shifting mechanism 142 is carried by the bracket 139. This controlling is normally done by a schedule developed for a specific installation and product.

Second Embodiment

The invention can be practiced with a more economical embodiment—as illustrated in FIGS. 10–13 and 10A–13A. Here, again, like numerals are used for similar functioning parts—but increased to the 200 series. This embodiment is especially suited for installations where speed is not an essential. This embodiment operates at about one-half the speed of the first embodiment—and at about one-half the cost.

In FIG. 10 the frame is again designated by the symbol F (see the lower right) and is seen to support a 4-bar linkage generally designated 200. The linkage includes a first bar 221, a second bar 234, a third bar 224 and a fourth bar 225. The first bar 221 in this second embodiment is to the left—as contrasted to the first embodiment where the first bar 121 is to the right in FIG. 6. We designate the bars "first" because these are the ones coupled to the skew arms SA in FIGS. 6 and 10A.

Figure 10A:
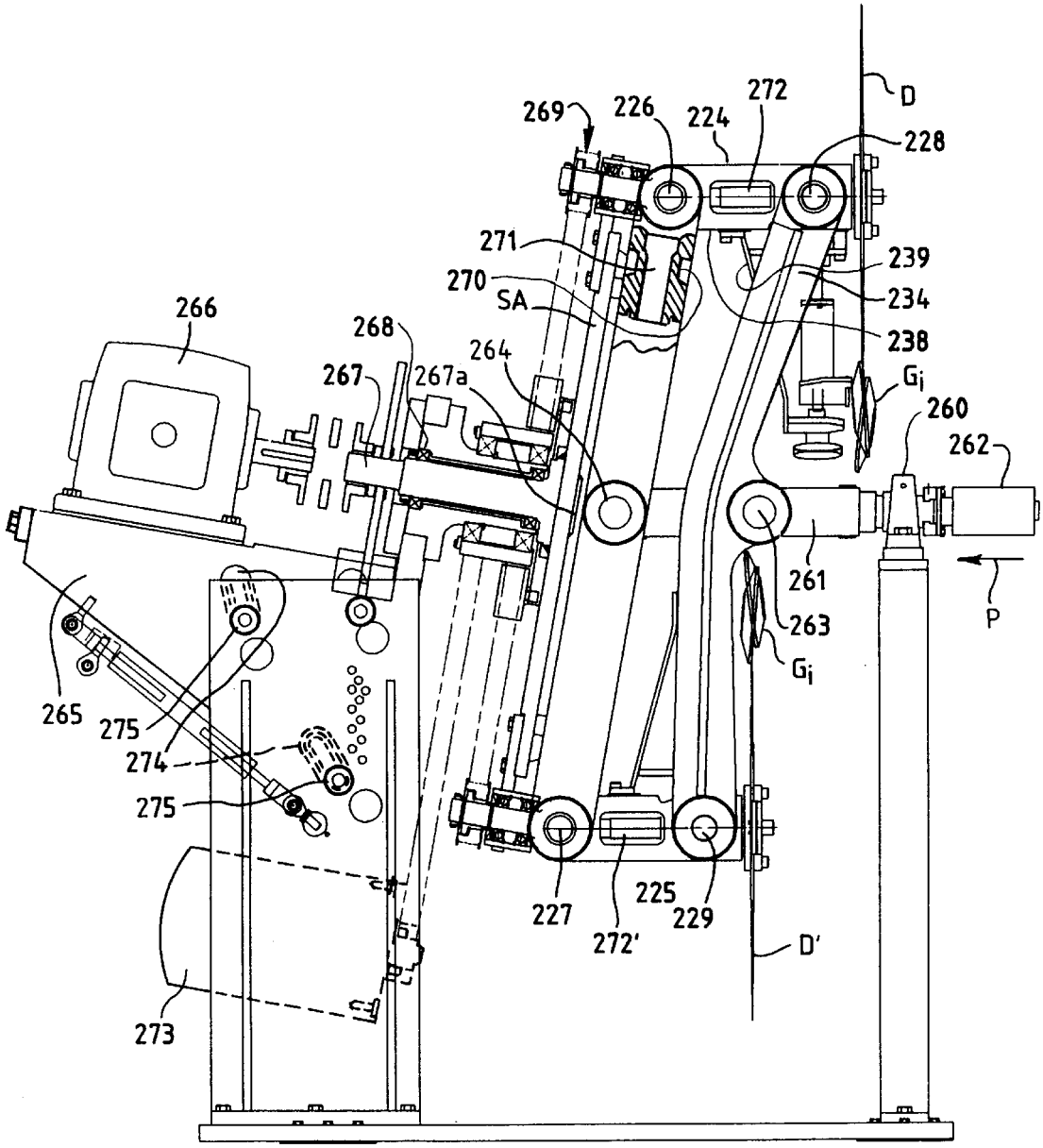

As seen in FIG. 10A, these bars are pivotally interconnected at what might be considered the corners of the parallelogram as at 226 connecting the first bar 221 with the third bar 224. Another pivotal connection is designated 228 connecting the third bar 224 with the second bar 234. A pivotal connection similar to that at 228 is designated 229 and this is at the lower right portion of the 4-bar linkage 220 connecting the fourth bar 225 with the second bar 234. Lastly, the pivot connection 227 which is the same as the connection 226 couples the first bar 221 with the fourth bar 225.

Although the invention has been described in conjunction with the usual two bladed continuous motion saw, it will be appreciated that the advantages of the invention may be applied to saws with one, three or four blades inasmuch as the invention permits a balancing of forces through the geometry of the controlling linkage. With a single blade, for example, a suitable counterweight is provided on the bar or arm end lacking the blade.

The frame F supports a bearing 260 (compare the central part of FIG. 11 with the right hand part of FIG. 10) which in turn rotatably supports a shaft 261 (seen in the central right portion of FIG. 10). The shaft 261 at its extreme right end is equipped with a rotary union 262 which permits pneumatic power to be sent to the grinders for cycling then on and off. As seen in FIG. 10A, the shaft 261, intermediate its ends, is pivotally coupled as at 263 to the second bar 234 and at its left end coupled to the first bar 221 at 264.

The 4-bar linkage 200 is also indirectly supported by the frame via the skew arm SA. This can be appreciated by first considering the extreme lower left hand portion of FIG. 10 where a portion of the frame is designated F' and is seen to carry a bracket 265. As can be seen in FIG. 10A, the bracket 265 carries a gear box 266 driven by a motor (not shown). Coupled to the output of the gear box 266 is a shaft 267 which is also supported on the bracket 265 by a bearing member 268. The shaft 267 carries at its right hand end—as at 267*a*—the skew arm SA. As can be appreciated from FIG. 12, the skew arm SA is positioned between the spaced apart portions 221*a* and 221*b* making up the first bar 221. FIG. 12 also shows the drive generally designated 269 for the blades D, D'—see also FIGS. 10A and 13.

Referring specifically to FIG. 10A, the relatively elongated skew arm SA is equipped with couplings 270 at the upper and lower ends. Only that adjacent the upper end is designated. However, it will be appreciated that each of skew arm SA and bars 221 and 234 is symmetrical about a mid-plane.

Each coupling 270 in turn provides a housing for a pivot shaft 271. The housings of the couplings 270 additionally are fixed to the first bar 221 while the pivot shafts 271 are fixed to the skew arm SA. So the skew arm SA rotates with the first bar 221 but there is free pivotal movement of the first bar 221 relative to the skew arm SA.

Each of the third and fourth bars 224, 225 has a power end and a work end—these relating to the left and right ends, respectively, as shown in FIG. 10A. At the power end of the third bar 224, for example, there is provided the drive 269 which through an intermediate shaft 272 drives the upper disc blade D. Power is derived from motor 273—see FIG. 10A at the lower left. A similar arrangement 272' is provided relative to the fourth bar 225 for driving the lower disc blade D' and which is provided at an extension of the fourth bar 225.

Operation

In operation, the 4-bar linkage 200 rotates to bring the upper disc blade D downwardly through an arc of 180° to the position of the lower disc blade D'. As the linkage passes through the 90° part of its cycle, the two disc blades D, D' are transversely aligned. The shaft 261 and the connections thereof to the first and second bars 221, 234 as at 264 and 263, respectively, are responsible for skew compensation and to maintain the orientation of the disc blades perpendicularly to the web plies in the linear path when severing the same. In other words, the skew angle again provides for the movement of the blades D, D' in the direction of movement of the material to be cut. However, for the cut to be acceptable, the blades D, D' have to be exactly perpendicular to the path of travel of the product and this is what is achieved through the shaft 261 and its connections as at 263, 264 to the second and first bars.

More particularly, the skew arm SA drives the first bar 221 through the couplings 270. The first bar 221 then drives the shaft 261 and also drives the third and fourth bars 224 and 225. These, in turn, drive the second bar 234. However, the fixing of the shaft 261 within the bearing 260 applies a modulation to the 4-bar linkage 200 at all times to maintain the blades D, D' perpendicular to the material being cut—in the path P which is parallel to the axis of shaft 261.

The cut length can be changed by changing the skew angle between the shaft 267 which drives the skew arm SA and the shaft 261. This is achieved advantageously in the illustrated embodiment by providing slots 274 in the bracket 265 and securing the bracket in a desired position by tightening the nut-bolt coupling 275—see the central left portion of FIG. 10A.

By driving the 4-bar linkage 200 from the shaft 267 a more steady angular velocity is provided the linkage 200 than would result from driving shaft 261. The latter would cause a speed pulsation of the 4-bar linkage 200. This occurs, for example, because the perpendicular distance from the center line of the shaft 261 to the center line of the third bar 224 changes through the orbit. In contrast, the relationship of a center line of the shaft 267 to the third bar 224 and fourth bar 225 does not change through the orbit—so pulsation is avoided.

Also, in the illustration given, each of the connections between the upper and lower portions of drive 269 and the intermediate shafts 272, 272' is advantageously a constant velocity universal joint 276—see FIG. 13A. A suitable joint is available from CON-VEL, INC. located in Summerville, S.C. This joint—as contrasted to a universal joint, i.e., a Cardan joint—insures that any velocity pulsation effects due to oscillation of the third bar relative to the first bar 221 or oscillation of the first bar 221 relative to the skew arm SA will not affect the speed of the blades D, D'.

Also in FIG. 13A, the other elements previously referred to are identified, viz., drive 269, skew arm SA, the spaced apart portions 221*a*, 221*b* of first bar 221, pivotal connection 226 between bars 221 and 224, shaft 272 and blade D. Also shown are the spaced apart portions 234*a* and 234*b* of the second bar 234. As indicated previously the second bar 234 is pivotally connected to the third bar 224 by the pivot 228—see the right hand portion of both FIGS. 10A and 13A.

As with the first embodiment, the blades D, D' are equipped with grinding stones as at $G_i$. These are inward of the orbit OR (FIG. 11) at all times, i.e., within the orbit OR defined by the centers or revolution axes of the blades D, D'. This aids in reducing the centrifugal loading. To accommodate these, the second bar 234 is angled to provide a somewhat convex attitude relative to the first bar 221.

The inward positioning of the stones $G_i$ is provided by mounting the bracket 239 (see FIG. 10) on the undersurface 238 of the third bar 224. This corresponds to the previously referred to mounting surface 138 provided as part of the First Embodiment (see FIG. 9). Such a mounting surface is also seen on the model of FIG. 8—as at 41. Thus, in each case the blade and its associated grinding stone means are carried by or supported on an arm of the 4-bar linkage which, in turn, is coupled to the skew arm SA.

A suitable drive and control for the operation of the stones can be seen in co-owned U.S. Pat. No. 5,152,203. This and the other U.S. Pat. No. 4,347,771 mentioned hereinbefore were specifically designed for application to the CM saw of patent '813. For that a controller CR is provided on the machine frame—see FIG. 1. The controller regulates the plunging motion via air cylinder 279. The plunging motion causes both stones to simultaneously contact the disc blade. The adjustment motion occurs as the diameter of the blade diminishes throughout its life cycle.

The invention here also makes use of guards as at 277 relative to the upper disc blade D—see FIG. 11A. Only a portion 277' is shown in FIG. 11A relative to the lower blade D'. Each guard, however, is interrupted as at 278 (in the upper part of FIG. 11A) to permit radially inward movement of the stones $G_i$. When the blade is new—as at D' in the lower part of FIG. 11A, the stones $G_i$ are most removed from the blade axis, i.e., the axis of shaft 272. Then, as the blade becomes duller, grinding occurs, resulting in diameter reduction, so the air cylinder arrangement 279 is also actuated to move the stone supporting bracket closer to the axis of the shaft 272 (or 272').

SUMMARY

The inventive method of operating an orbital saw for transversely severing elongated superposed, multi-ply web material such as logs of convolutely wound material (FIG. 3) and/or stacked tissue or the like (FIG. 4) which includes the following steps and structure:

1. providing a frame F defining a linear path P for elongated web plies and including (a) conveyor means C operatively associated with the frame for continuously advancing the elongated web plies L along the linear path, (b) a relatively elongated arm SA rotatably mounted on the frame and means 36, 136, 267 on the frame for rotating the arm about an axis S skewed with respect to the linear path, (c) means in the form of a 4-bar linkage 20, 120, 200 coupled to the arm SA and carrying the blade(s) D, D' and having means 34, 134, 234 for compensating for the skew θ, (d) rotating means 144, 269 on the bar means for rotating the blade(s) and with rotation of arm orbiting the blade(s) and with the blade orbit (OR) intersecting the linear path,
2. providing the coupled means 20, 120, 200 with a grinding stone $G_i$ for the blade, and
3. positioning the grinding stone always radially inwardly of the blade center orbit OR whereby centrifugal forces are reduced and cyclic loading is substantially eliminated.

The grinding stone is advantageously contacted with the blade intermittently and the invention preferably employs two pairs of stones $G_i$, one pair for each disc blade D, D' with one on each side of the blade to develop a beveled edge. Thus, the invention optimally employs two blades, one at each end of the elongated arm. In this case, and where the superposed elongated web plies have a cross-sectional area of at least about 3.5 $in^2$ (2200 $mm^2$), it is advantageous to have the centers of the two blades at least 30" (750 mm) apart.

While in the foregoing specification a detailed description of embodiments of the invention have been set down for the purpose of illustration and compliance with the statute, many variations in the details herein given may be made by those skilled in the art without departing from the spirit and scope of the invention.

We claim:

1. A method of operating an orbital saw for transversely severing elongated, superposed, multi-ply web material comprising:

providing a frame defining a linear path for elongated web plies, continuously advancing said elongated web plies along said linear path, rotatably mounting a relatively elongated arm on said frame, rotating said arm about an axis skewed with respect to said linear path, rotatably mounting a blade on said arm for rotation therewith, rotation of said arm orbiting said blade with the orbit of said blade intersecting said linear path, and mounting a grinding stone for said blade on said arm so that the grinding stone is always positioned radially inwardly of said blade orbit whereby centrifugal forces are reduced and cyclic loading is substantially eliminated.

2. The method of claim 1 including the step of contacting the grinding stone intermittently with said blade.

3. The method of claim 1 in which the blade has a pair of cutting surfaces and including the step of grinding both of said cutting surfaces by mounting said grinding stone adjacent one of said cutting surfaces and mounting a second grinding stone adjacent the other cutting surface.

4. The method of claim 1 including the step of severing said web material at least twice during each rotation of said arm by mounting at least two blades on said arm.

5. The method of claim 1 including the step of severing said web material at least twice during each rotation of said arm by mounting an elongated bar having a pair of ends on said arm and mounting said blade on one end of the elongated bar and mounting a second blade on the other end of the elongated bar.

6. The method of claim 1 in which said skew is compensated by coupling a 4-bar linkage to said elongated arm.

7. The method of claim 6 in which said 4-bar linkage includes first, second, third, and fourth bars, and mounting said blade and said grinding stone on one of said third or fourth bars.

8. The method of claim 7 in which said blade and said grinding stone are mounted on said third bar and mounting a second blade and a second grinding stone on said fourth bar.

9. The method of claim 7 in which the blade has a pair of cutting surfaces and including the step of grinding both of said cutting surfaces by mounting said grinding stone adjacent one of said cutting surfaces and mounting a second grinding stone adjacent the other cutting surface.

10. The method of claim 1 in which said advancing step includes advancing logs of convolutely wound material.

11. The method of claim 1 in which said advancing step includes advancing interfolded plies.

12. The method of claim 1 in which the advancing step includes advancing web plies with a cross sectional area of at least about 3.5 $in^2$ (2200 $mm^2$), the blade having a center, and orbiting said blade so that the center of the blade follows an orbit having a diameter of at least about 30 inches (750 mm).

13. The method of claim 12 in which the blade has a pair of cutting surfaces and including the step of grinding both of said cutting surfaces by mounting said grinding stone adjacent one of said cutting surfaces and mounting a second grinding stone adjacent the other cutting surface.

14. A method of operating an orbital saw for transversely severing elongated, superposed, multi-ply web material comprising:

providing a frame defining a linear path for elongated web plies, continuously advancing said elongated web plies along said linear path, rotatably mounting a relatively elongated arm on said frame, rotating said arm about an axis skewed with respect to said linear path, coupling a four-bar linkage to said arm, said four-bar linkage having means for compensating for said skew, rotatably mounting a blade on said four-bar-linkage, providing rotating means on said linkage for rotating said blade, rotation of said arm orbiting said blade with the orbit of said blade intersecting said linear path, and mounting a grinding stone for said blade on said four-bar linkage so that the grinding stone is always positioned radially inwardly throughout the entirety of said blade orbit whereby centrifugal forces are reduced and cyclic loading is substantially eliminated.

15. The method of claim 14 in which said four-bar linkage includes first, second, third and fourth bars, coupling said first bar to said elongated arm, one of said third and fourth bar carrying said blade, and said second bar having a pair of end portions which extend angularly relative to the first bar to accommodate said grinding stone.

16. A method of operating an orbital saw comprising the steps of:

providing a frame defining a linear path for elongated web plies, continuously advancing said elongated web plies along said linear path, rotatably mounting a relatively elongated arm on said frame, rotating said arm about an axis skewed with respect to said linear path, rotatably mounting a plurality of blades on said arm, compensating for the skew of said arm so that the blades rotate perpendicularly to said linear path, rotation of said arm orbiting said blades with the orbit of said blades intersecting said linear path, and mounting a grinding stone for each said blade on said arm so that each grinding stone is positioned radially inwardly of said blade orbit whereby centrifugal forces are reduced and cyclic loading is substantially eliminated.

17. The method of claim 16 in which said step of rotatably mounting blades comprises mounting a pair of blades.

18. The method of claim 16 in which said step of rotatably mounting blades comprises mounting three blades.

19. The method of claim 16 in which each of the blades has a pair of cutting surfaces and including the step of grinding both of said cutting surfaces by mounting said grinding stone adjacent one of said cutting surfaces and mounting a second grinding stone adjacent the other cutting surface .

20. A method of operating an orbital saw to transversely sever superposed elongated web plies into shorter length products comprising the steps of advancing, along a linear path, said superposed elongated web plies having a cross-sectional area of at least about 3.5 $in^2$ (2200 $mm^2$), providing a 4-bar linkage including first and second bars extending generally parallel to each other and third and fourth bars, each of said bars having a pair of ends, connecting said first and second bars adjacent the ends thereof with said third and fourth bars to provide at least one degree of pivotal freedom of said third and fourth bars relative to said first and second bars, rotatably mounting a disc blade on each of said third and fourth bars, each of the disc blades having a center, rotating said first bar about a first axis to orbit said blades with the orbit of said blades intersecting said linear path and with centers of said disc blades being at least 30 inches (750 mm) apart while skewing said first axis at a minor acute angle to said linear path, rotating said second bar about a second axis different from said first axis to compensate for said skewing and to orient said disc blades perpendicular to said web plies in said linear path when severing said web plies, mounting a grinding stone and on each of said third and fourth bars so that each grinding stone is positioned radially inwardly of the orbit of said blades throughout the entirety of said blade orbit whereby centrifugal forces are reduced and cyclic loading is substantially eliminated.

21. The method of claim 20 in which each of the blades has a pair of cutting surfaces and including the step of grinding both of said cutting surfaces by mounting said grinding stone adjacent one of said cutting surfaces and mounting a second grinding stone adjacent the other cutting surface.

* * * * *